United States Patent [19]

Meyer et al.

[11] Patent Number: 4,892,463

[45] Date of Patent: Jan. 9, 1990

[54] RAIL MOUNTED EJECTOR

[75] Inventors: Hans Meyer, Waldbronn; Manfred Steegmanns, Frankfurt, both of Fed. Rep. of Germany

[73] Assignee: Deutsche Gesellschaft fur Wiederaufarbeitung von Kernbrennstoffen mbH, Hanover, Fed. Rep. of Germany

[21] Appl. No.: 242,220

[22] Filed: Sep. 9, 1988

[30] Foreign Application Priority Data

Sep. 10, 1987 [DE] Fed. Rep. of Germany ..... 3730438

[51] Int. Cl.[4] ..... F04F 5/00

[52] U.S. Cl. ..... 417/151; 417/198; 417/454; 239/104; 239/600; 376/407

[58] Field of Search ..... 417/151, 160, 198, 163, 417/174, 454, 183, 193, 182, 177, 178; 239/10, 104, 123, 318, 600; 376/407, 372

[56] References Cited

U.S. PATENT DOCUMENTS

| | | | |
|---|---|---|---|
| 3,510,223 | 5/1970 | Strebel et al. | 417/454 |
| 3,643,688 | 2/1972 | Meinert | 417/183 |
| 3,750,961 | 8/1973 | Franz | 239/600 |
| 3,838,946 | 10/1974 | Schall | 417/393 |
| 4,184,806 | 1/1980 | Prinz | 417/183 |

FOREIGN PATENT DOCUMENTS

| | | |
|---|---|---|
| 161981702 | 3/1968 | Fed. Rep. of Germany . |
| 2810767 | 9/1978 | Fed. Rep. of Germany . |
| 8313783 | 11/1983 | Fed. Rep. of Germany . |
| 1572990 | 5/1978 | United Kingdom . |

*Primary Examiner*—Carlton R. Croyle
*Assistant Examiner*—Robert N. Blackmon
*Attorney, Agent, or Firm*—Cushman, Darby & Cushman

[57] ABSTRACT

The invention relates to an ejector to be placed in rooms which are inaccessible to human beings. It comprises a casing with a diffuser bore, a head chamber, and a space for a working fluid including a lateral working fluid connection. The working fluid nozzle comprises a working fluid chamber which is connected through bores with the working fluid space and, inside the casing, it seals the head chamber from the working fluid space. The nozzle of the working fluid chamber opens into the head chamber and faces the diffuser bore. The invention is characterized in that the ends of the casing and of the working fluid nozzle each are embodied as a radial flange which flanges are held together by bolts adapted to be operated by a manipulator. At the end of the working fluid nozzle flange there is a handle which is operable by a manipulator to pull the working fluid nozzle out of the casing and to reintroduce it, respectively.

5 Claims, 1 Drawing Sheet

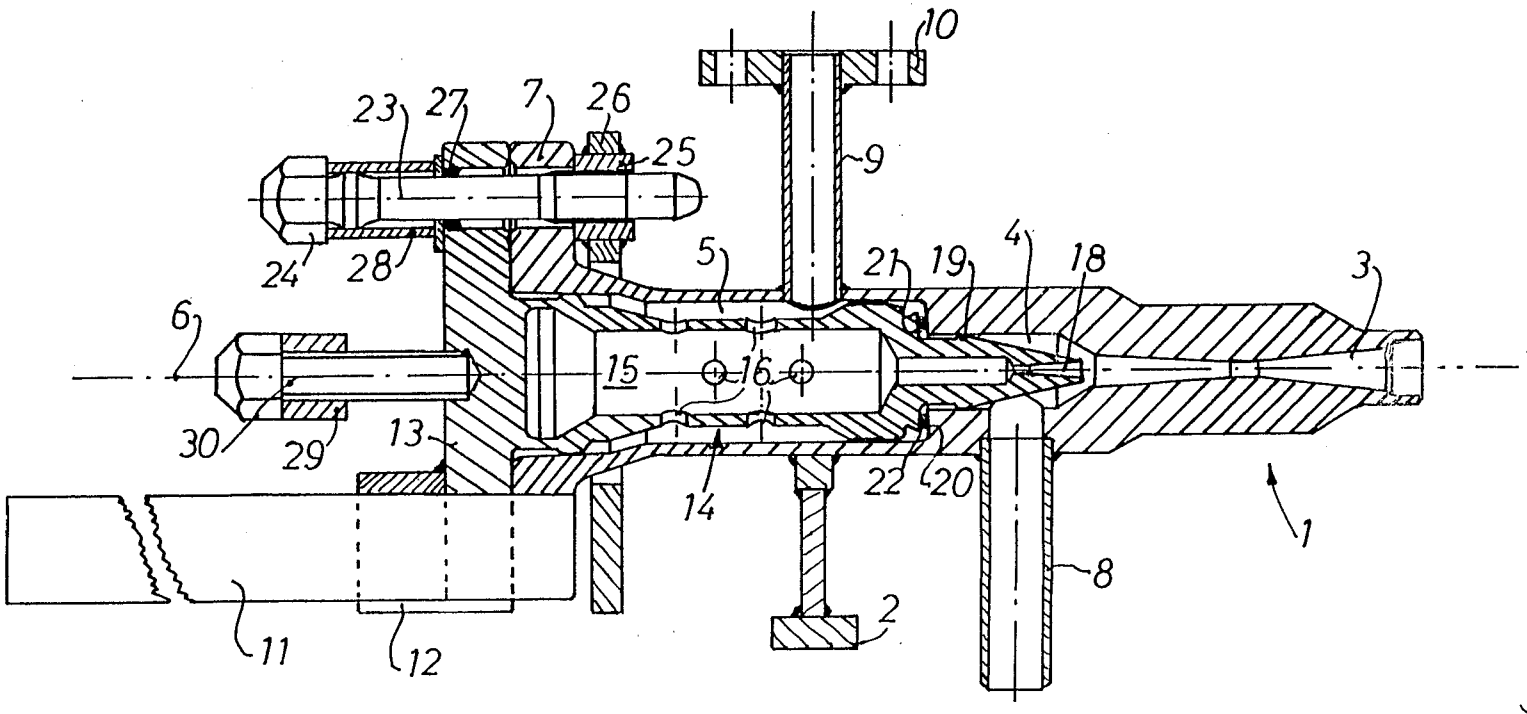
1
2
3
4
5
6
7
8
9
10
11
12
13
14
15
16
18
19
20
21
22
23
24
25
26
27
28
29
30

RAIL MOUNTED EJECTOR

FIELD OF THE INVENTION

The instant invention relates to an ejector comprising a pump casing having at its one axial end a diffuser bore and at its other axial end an opening for insertion of a working fluid nozzle as well as radial working fluid and suction connections arranged offset behind each other in the axial direction, the working fluid nozzle including at least one through bore in fluid communication with the working fluid connection as well as an extension firmly joined to it and projecting out of an opening formed in the casing.

BACKGROUND OF THE INVENTION

Ejectors are used for conveying, compacting, or mixing tasks in rooms which man can no longer enter into because of the radiation load or other noxious influences prevailing in them, such as so-called "hot cells". As a rule, ejectors consist of two components only, namely, the casing forming a head and a diffuser as well as a working fluid nozzle housed in the casing. It is a particular advantage of such ejectors that they do not comprise any mechanically movable parts and, therefore, are subject to relatively little mechanical wear.

With such an ejector, a working fluid is blown by the working fluid nozzle through the interior of the head into the diffuser, which forms a long channel, narrowing at first and then widening again. A substance which is capable of flowing is sucked into the head through a suction connection and entrained through the diffuser. The preferred working fluid is vapor of such a nature that it is condensed in the diffuser, whereby the efficiency and suction head of the ejector are improved.

Under substantially constant marginal conditions the dimensioning of the bore in the working fluid nozzle in the first place determines the exhaust capacity and delivery obtainable by such an ejector. To vary those properties, therefore, the working fluid nozzle must be replaced by a different one of different dimensions. Moreover, the bore of the working fluid nozzle is subject to certain wear in the course of time so that it is most convenient to exchange it and replace it with a new one. However, the predominant disturbance occurring with an ejector is the plugging of the jet nozzle, and then it is mainly the bore of the diffuser which is obstructed.

Up to now manipulators have been used in rooms which are inaccessible to man for disassembling the entire ejector if disturbances of ejectors occurred that were no longer acceptable. The ejector thus has to be replaced by a new one or, perhaps, repaired outside the hot cell. That procedure, of course, is extremely difficult and time consuming. To overcome this disadvantage, it was proposed (DE-OS 28 10 767) that the working fluid nozzle of such an ejector be extended at its end remote from the diffuser by a bar passing through the wall of the hot cell.

In such a device, since the working fluid no longer can be fed, as customary, through the rear end of the working fluid nozzle, the working fluid nozzle comprises a working fluid chamber provided with a radial aperture opening into a working fluid space at the backside of the casing which forms the diffuser. The working fluid space is sealed with respect to the head, i.e., the space in which lies the open mouth of the working fluid nozzle. Further sealing is provided to the rear in the direction of the bar which extends the working fluid nozzle.

The bar which extends the working fluid nozzle can be displaced in the direction toward the interior of the casing when an obstruction of the diffuser occurs. The tip of the working fluid nozzle is pushed all the way into the mouth of the diffuser where its conical outer wall enters into sealing engagement with the diffuser inlet. Thus it is possible to use a sharp energy-rich working fluid jet to blow free the diffuser. At the same time, in this position the diffuser is blocked toward the suction connection. Therefore, it is possible to flush free the head space by a cleansing agent through a cleaning connection opening into the casing and disposed opposite the suction connection, without this cleansing agent getting into the diffuser and thus into the pressure outlet of the ejector. Thus, it is possible, for instance, to remove corrosions and deposits by corresponding chemicals and thereby clean the ejector again.

However, if such an ejector were to be used in regions in the interior of a hot cell which are removed from the walls thereof, it would be necessary to provide either a remote control drive or drive means operable by a manipulator to displace the working fluid nozzle until it abuts against the diffuser or to return it into its operating position. In any case, the resulting structure would be very complicated and, accordingly, susceptible to trouble and, for that reason, not suitable for erection in a hot cell. On the other hand, the cleaning effect obtainable by the known ejector is rather small. For instance, it is possible that not only the narrowest place of the diffuser bore becomes plugged but also, in addition, deposits form in the inlet zone of the diffuser bore and in the interior of the head region. When such deposits exist, the working fluid nozzle can no longer be driven into its cleaning position.

SUMMARY OF THE INVENTION

In view of the prior art, it is an object of the instant invention to modify the known ejector specified initially such that it can be cleaned by manipulator operation, even if stubbornly fouled, without having to disassemble the ejector itself from its conduit connections and replace it by a new or cleaned one.

This object is met, in accordance with the invention, in that the extension of the working fluid nozzle is formed as a cover plate including a flange, the casing likewise comprising a flange adjacent its opening, the two flanges being positioned opposite each other and adapted to be screwed together by clamping bolts. An extractor is mounted on the cover plate of the working fluid nozzle so as to be grasped by a manipulator for extracting the working fluid nozzle out of the casing.

The end of the casing remote from the diffuser, on the one hand, and the extension of the working fluid nozzle, on the other hand, are designed as two opposed flanges which are clamped together by bolts of such design as to be releasable by manipulators or tightened by them. These bolts preferably are embodied by necked-down bolts which protrude beyond the flange of the working fluid nozzle at the side remote from the diffuser, their respective head being supported on that flange by way of a pressure sleeve. Consequently, the heads of those bolts can be grasped more easily by the manipulator.

Furthermore, the free end of the hexagonal head of this bolt is extended conically, thereby presenting a guide portion which guides the rotatable hexagonal recess of a manipulator even if placed inaccurately on the head of the bolt.

Moreover, the working fluid nozzle comprises an extractor or handle at its flange, preferably at the side remote from the diffuser, to be grasped by a manipulator for pulling the flange with its working fluid nozzle out of the casing or reinserting them in the casing.

In view of the fact that a working fluid connection is situated laterally at the casing, both with the known ejector started from and with the ejector according to the invention, rather than at the end of the casing as is normal with ejectors, the end of the casing is totally free for access by manipulators. For this reason it is possible to loosen the retaining or clamping bolts of the flanges and then pull the working fluid nozzle still fitted in the casing with its centering means axially in a rearward direction out of the casing by means of manipulators.

Thereupon a cleaning device, such as a rotating brush, a pressurized air nozzle, or the like, may be introduced into the casing, depending on the kind of disturbance to be removed or change to be made, and left there until cleaning has been accomplished or the plugging eliminated. A sleeve likewise may be slid into the casing to seal off the working fluid connection, the suction connection, and the diffuser bore and clear the interior of the casing of accumulations, corrosion, or the like by a mordant or cleansing agent without running the risk of this cleansing agent getting into the conduit system connected to the ejector.

It is possible as well to replace the working fluid nozzle by another one so that the ejector provided can be changed either to be adapted to different marginal conditions or to have a different capacity at unvarying marginal conditions, without having to disassemble it.

It would even be conceivable to ream the diffuser bore by a reamer held by a manipulator, provided the chips produced which may enter the pipe system do not cause any harm there.

It is readily obvious that the loosening of a few, preferably no more than three flange bolts and the withdrawal of the working fluid nozzle by means of manipulators which are available can be done quickly and without any effort. The working fluid nozzle thus may be removed from the casing no matter what the circumstances, i.e., even if it should stick, because the precipitations from the fluid to be pumped always form in front of the working fluid nozzle and sediments in the range of the working fluid connection always can be avoided by using an appropriately clean working fluid.

Since the casing is freely accessible once the working fluid nozzle has been removed, it is likewise possible to inspect the casing through a television camera or photoconductor optical system before taking up the task of cleaning so as to avoid applying ineffective or harmful cleaning methods.

If program-controlled manipulators are employed, the working fluid nozzle can be withdrawn from and introduced into the casing under certain limiting conditions without any risk of damage once the procedure has been programmed. In industrial-scale plants, however, these limiting conditions can be realized at extremely high expenditure only or not at all. Therefore, manipulators with human remote control are preferred, the visual checking being effected through television cameras. Especially with the latter manipulators it is advantageous, according to a preferred modification of the invention, to apply a longitudinal guide means at the backside of the casing and leading away from it. A slide member attached to the flange of the working fluid nozzle can be slid or placed on this longitudinal guide means and carried for displacement along the same. The threading or placing of the slide member on the longitudinal guide means can be facilitated by suitable inclined surfaces or the like. If the control should be faulty in accomplishing that, the mutual abutting of the longitudinal guide means and the slide member by no means will cause any serious damage to these parts. Yet if the slide member has been placed properly on the longitudinal guide means, it can be displaced along the same together with the working fluid nozzle and there is absolutely no risk that the sensitive outside surface, as a rule ground to high precision, of the working fluid nozzle will hit against any part of the casing.

In principle, it is possible to provide the longitudinal guide means with an end stop and to make it so long that, with a fully extended working fluid nozzle, sufficient space is left between the same and the casing in order to put cleaning devices into the casing by means of manipulators. Preferably, however, the length of the longitudinal guide means is selected so as to exclude the risk of collision between the casing and the working fluid nozzle when the slide member is being mounted on the longitudinal guide means.

The slide member is removable and reinsertable. According to another preferred modification of the invention a clearing means is provided which likewise comprises a slide member adapted to be mounted on the longitudinal guide means so that the clearing means also can be entered effortlessly into the casing without causing any damage.

Since the working fluid nozzle itself is centered in the casing, an additional mutual centering of the flanges, in principle, may be dispensed with. However, to relieve the centering means between the working fluid nozzle and the casing in accordance with a preferred modification of the invention, an additional centering means is arranged in the area of the flanges, preferably in the form of centering pins which, in turn, preferably are disposed at the flange of the working fluid nozzle and adapted for engagement in centering bores formed in the flange of the casing.

Fundamentally, it is possible to provide a piston and piston ring assembly for the simultaneous centering and sealing between circular cylindrical portions of the working fluid nozzle and the casing, as is the case with the ejector mentioned initially and started from. Yet it is a disadvantage of such an embodiment that even the slightest corrosion requires extremely great axial forces to separate the working fluid nozzle and the casing axially from each other. Therefore, in accordance with a preferred modification of the invention the conical outer surface of the working fluid nozzle is widened up to an annular bulge which theoretically rests in line contact on a circular cylindrical inner bore and presents the centering means. Since the zone of contact which theoretically is lineshaped in fact a very small area in which sticking or seizing may occur between the contacting surfaces, only rather small forces are required to pull the working fluid nozzle out of the casing even though the centering is entirely sufficient.

The sealing between the working fluid space and the head space of the casing is essential in order to prevent an out-of-center working fluid flow from being established since that might impair the operating characteristics of the ejector. In this case, too, it would be possible to effect radial sealing between the outside of the working fluid nozzle and the inside of the casing. However, a sealing ring of such a radial seal might become damaged if it sticks after a longer period of operation and the working fluid nozzle is pulled out so that the sealing ring would have to be replaced or remainders of the sealing ring removed from the casing before reinstalling the working fluid nozzle. For this reason it is suggested, according to a preferred modification of the invention, that a radial step and a radial seat be formed opposite each other at the working fluid nozzle and at the casing, respectively, and an axial annular seal arranged between them. The latter preferably is fixed to the working fluid nozzle in order to facilitate its replacement. If this axial annular seal should get stuck it will merely be pulled off the sticking as the working fluid nozzle is withdrawn, rather than being sheared off as is the case with a radial seal.

BRIEF DESCRIPTION OF THE DRAWING

The subject matter of the invention will be described further, by way of example, with reference to the accompanying drawing, in which:

The single FIGURE is a longitudinal sectional elevation of the ejector according to the invention.

DESCRIPTION OF THE PREFERRED EMBODIMENT

The ejector of the FIGURE comprises a casing 1 adapted to be attached or mounted stationarily on a foundation, such as by a base 2. In its right-hand, front part the casing 1 comprises a diffuser bore 3 and to the left thereof in the drawing an enlarged head chamber 4, and still further to the left in the drawing a much enlarged, substantially circular cylindrical working fluid space 5. To the left of the working fluid space 5 there is an enlarged space which is open to the outside. This enlarged space, the working fluid space 5, the head chamber 4, and the diffuser bore 3 all lie on a common axis 6.

The left open end of the casing 1 is enlarged in the form of a flange 7 of the casing extending substantially radially with respect to the axis 6 and having a radial seating surface at its side remote from the diffuser bore 3.

A suction connection 8 opens radially into the head chamber 4. A working fluid connection 9 opens into the working fluid space 5, likewise radially and opposite the suction connection 8 in the embodiment illustrated. The working fluid connection is embodied by a pipe end carrying at its free end a fastening flange 10 which permits the working fluid connection 9 to be connected in pressure tight fashion to a pressurized vapor line.

At the lower side of the casing flange 7 there is a straight guide rail 11 which is extends parallel to the axis 6. In cross-section the guide rail is an upright, narrow rectangle and its dimensions are such that it is capable of carrying at its free end, without noticeable bending, the weight of the working fluid nozzle to be described below.

A slide 12 is mounted for displacement on the guide rail 11. It has a substantially U-shaped cross section and embraces the top and the side flanks of the guide rail in sliding fit, extending just a little from either side below the bottom of the guide rail 11. The slide 12 is adapted to be pulled off the guide rail 11 to the left, as seen in the drawing, and to be pushed on again.

A flange 13 of the working fluid nozzle is fixed to the slide 12 and extends coaxially with the axis 6 substantially in a radial direction, being formed with a radial seating surface by which it can be brought into fitting engagement with the flange 7 of the casing.

A working fluid nozzle 14 is joined integrally to the working fluid nozzle flange 13 at the side facing the diffuser bore, the nozzle being formed as a hollow body of revolution which is coaxial with the axis 6. The working fluid nozzle 14 includes a working fluid chamber 15 which communicates through a number of radial bores 16 with the working fluid space 5 in the casing 1. In the area of the working fluid chamber 15 the outer circumference of the working fluid nozzle 14 is dimensioned such that an annular space is formed between the outer wall thereof and the opposed wall of the casing 1, the working fluid connection 9 opening into this annular space.

The right end of the working fluid nozzle 14, as seen in the drawing facing the diffuser bore 3, tapers conically at the outside and has a jet bore 18 in the conical portion, opening into the head chamber 4 at a location opposite the diffuser bore 3. The conical outer surface widens from the diffuser bore 3 end in conical fashion toward the working fluid nozzle flange 13 end, forming a centering bulge 19 behind which the outer diameter of the working fluid nozzle 14 is set back slightly. The centering bulge 19 abuts against the inner wall of the circular cylindrical bore in the casing 1 defining the head chamber 4.

This bore in the casing widens abruptly into that portion of the casing which presents the working fluid space 5, forming a radial seat 20 at the transition. Opposite the seat 20, the working fluid nozzle 14 is formed with a radial step 21. Concentrically with the axis 6, a sealing ring 22 is mounted between the seat 20 and the opposing step 21 and, upon abutment of the working fluid flange 13 against the casing flange 7, it is compressed so that it effectively prevents working fluid from exiting out of the working fluid space 5 into the head chamber 4. The sealing effect is enhanced by the engagement between the centering bulge 19 and the inner wall of the head chamber 4.

The flange 7 of the casing and the flange 13 of the working fluid nozzle both include three aligned bores each offset by 120° with respect to one another, with a respective clamping bolt 23 each passing through each of them, the head 24 thereof being located at the side of the working fluid nozzle flange 13 remote from the diffuser bore 3. The free end of the clamping bolt 23 has a thickened threaded portion in engagement with a nut 25. The nuts 25 are interconnected by an outer ring 26 attached in bayonet fashion to the flange 7 of the casing and holding them in position with respect to the flange bores.

A screw locking device 27 each is arranged in that end of the bore facing toward the outside of the flange 13 of the working fluid nozzle. It prevents the thickened threaded portion of the clamping bolt 23 from slipping out of the bore mentioned so that the clamping bolt 23 is captive in the flange 13 of the working fluid nozzle.

The head 24 of the clamping bolt 23 rests on the flange 13 of the working fluid nozzle by way of a pressure sleeve 28 projecting from the outside of the flange. As is shown, the head 24 is a hexagonal head formed with a guide projection tapering conically toward its free end and facilitating the positioning of a hexagonal recess, on the part of the manipulator, on the bolt head 24. Likewise to be seen is the fact that the heads 24 of the clamping bolts 23 protrude so far from adjacent parts that it is easy for a manipulator to grasp and turn them.

The flange 13 of the working fluid nozzle is provided at the outside with a central handle 29 which is fastened by a draw-in bolt 30, coaxial with the axis 6, at a spacing from the flange 13 of the working fluid nozzle. The handle 29 is embodied by a traverse bar through the center of which passes the draw-in bolt 30 and at both ends of which there are centering pins (not shown in the drawing) which pass through fitting bores in the working fluid nozzle flange 13 and are received in centering blind bores in the casing flange 7.

The ejector shown is devised for being mounted in a hot cell or other room not to be entered by human beings in which manipulators must perform manipulations.

If the ejector illustrated is obstructed or other cleaning or maintenance work required or if the working fluid nozzle 14 is to be replaced by another one, then manipulators successively grasp the heads 24 of the three clamping bolts 23 and loosen the clamping bolts. Subsequently, a manipulator grasps the handle 29, and the working fluid nozzle 14 together with the working fluid nozzle flange 13 which is guided by the slide 12 on the guide rail 11 is pulled along the rail out of the casing 1 which in turn is retained in place by the base 2 and the fastening flange 7.

Now, a manipulator operated cleaning device preferably likewise comprising a slide similar to slide 12 may be entered into the casing 1 to carry out the necessary cleaning work in the same, such as scraping out and reaming the head chamber 4, clearing through the diffuser bore, or the like. Subsequently, the working fluid nozzle 14 is pushed back into the casing 1 by its slide 12 moving along the guide rail 11, or another working fluid nozzle 14 with its slide 12 is slid on the guide rail 11 and then pushed into the casing 1. Upon tightening of the three clamping bolts 23 by means of a manipulator the ejector once more is ready for operation.

What is claimed is:

1. An ejector comprising:

a pump casing having on one axial end thereof a diffuser bore and at another axial end, opposite said one axial end, an opening, said pump casing also having radial working fluid and suction connections arranged offset with respect to each other in the axial direction of said casing and a flange arranged at said another axial end of said casing;

a working fluid nozzle cooperating with said pump casing for insertion into said opening, said working fluid nozzle including at least one radial through bore in fluid communication with the working fluid connection, a cover plate and an extractor which extends towards said another axial end of said casing from said cover plate, said working fluid nozzle being inserted into said opening in said axial direction and firmly joined to said casing so as to project out of the opening, whereby said cover plate interacts with said flange of said casing such that said flange and cover plate may be screwed together by clamping bolts and whereby said extractor may be grasped by a manipulator for extracting the working fluid nozzle from the casing;

longitudinal guide means, parallel to said axial direction, for guiding said working fluid nozzle in said axial direction into said opening of said casing, said guide means including a rail arranged at said another axial end of said casing, remote from said diffuser bore, and a slide, whereby the cover plate of working fluid nozzle is held and guided along said rail to said opening by means of said slide; and further wherein the manipulator may introduce clearing means into the casing, instead of the working fluid nozzle for clearing means including a slide member adapted for engagement with the longitudinal guide means and displaceable along the same.

2. The ejector as claimed in claim 1, wherein the slide is removable from the longitudinal guide means and adapted to be remounted or pushed on the same again.

3. The ejector as claimed in claim 1, further comprising centering means for additionally centering the flanges.

4. The ejector as claimed in claim 1, wherein the including a working fluid nozzle has an outer wall tapering conically toward the diffuser bore, wherein the conical outer wall of the working fluid nozzle widens up to a centering bulge, and wherein a cylindrical bore is formed in the casing for fitting abutment against the centering bulge.

5. The ejector as claimed in claim 4, further comprising a flangelike step in the outer wall of the working fluid nozzle, an axially opposed seat formed in the casing, and an annular seal disposed between the step and the seat, preferably mounted on the step.

* * * * *